US005361940A

United States Patent [19]

Miller et al.

[11] Patent Number: 5,361,940

[45] Date of Patent: Nov. 8, 1994

[54] PUMP EVACUATION SYSTEM FOR BULK CONTAINERS OF HIGH VISCOSITY FLUIDS

[75] Inventors: Stanley M. Miller, Chicago; Martin P. McCormick, Lake Zurich, both of Ill.

[73] Assignee: Graco Inc., Minneapolis, Minn.

[21] Appl. No.: 68,974

[22] Filed: May 28, 1993

[51] Int. Cl.[5] ..... B67D 5/00

[52] U.S. Cl. ..... 222/77; 222/173; 222/261; 222/326; 222/389; 277/34

[58] Field of Search ..... 222/256-262, 222/325-327, 386, 389, 77, 405, 173; 277/34, 34.3

[56] References Cited

U.S. PATENT DOCUMENTS

| | | | |
|---|---|---|---|
| 1,455,980 | 5/1923 | Williams | 222/262 X |
| 3,282,469 | 11/1966 | Skonberg | 222/260 X |
| 4,073,409 | 2/1978 | Gardner et al. | 222/260 X |
| 4,898,304 | 2/1990 | Bacon, Jr. | 222/386 X |
| 5,265,763 | 11/1993 | Heinrici et al. | 222/77 |

FOREIGN PATENT DOCUMENTS

| | | | |
|---|---|---|---|
| 124224 | 4/1945 | Australia | 277/34.3 |
| 2029671 | 12/1971 | Germany | 222/405 |
| 3808054 | 9/1989 | Germany | 222/260 |

OTHER PUBLICATIONS

Murzan "Tote Pump System" advertising copy.

*Primary Examiner*—Andres Kashnikow
*Assistant Examiner*—Anthoula Pomrening
*Attorney, Agent, or Firm*—Douglas B. Farrow

[57] ABSTRACT

A ram assembly is designed for evacuating "bag-in-a-box" square bulk containers of viscous materials. The ram cylinder is centered over the bulk container and mounted so as to float relative to the frame allowing accomodation of various containers. An inflatable wiper seal is used in conjunction with elastomeric corner seals to tightly seal the corners.

4 Claims, 5 Drawing Sheets

PUMP EVACUATION SYSTEM FOR BULK CONTAINERS OF HIGH VISCOSITY FLUIDS

BACKGROUND OF THE INVENTION

Ram assemblies for evacuating fluid materials from bulk containers have been used for many years. In the past, such bulk containers have been mainly cylindrical with a round ram plate which is forced downwardly into the container having a pump attached to an opening, therein for evacuating the material from the container.

Recently, material suppliers have begun to supply material in square or other non-round containers which have corners. This has presented several problems. First of all, many such square shipping containers are not made to very tight dimensional tolerances and it is thus difficult to provide a mechanism which will consistently evacuate those containers. Secondly, a square sided container does not have the structural stability of a round container, that is, the sides of a filled box will bow outwardly to varying degrees depending on the container's construction.

The corners of a square container filled with a high viscosity fluid present a sealing problem when an attempt is made to use a ram plate. Further, bulk containers that vary in size present a locating problem because the container must be centered, not just located with stops built into the base of the machine.

SUMMARY OF THE INVENTION

It is therefore, an object of this invention to provide a ram system which solves the aforementioned problems in that it accommodates containers of varying dimension and those with curved sides as well as sealing the corners when the ram plate is forced into the container. It is further an object of this invention to provide a mechanism which accurately allows the ram plate to enter the container regardless of its positioning upon the base.

The instant invention evacuates high viscosity fluids such as tomato paste from bulk containers by applying pressure to the fluid through the use of a single ram cylinder and ram plate. Fluid flow is induced to pump inlets mounted on the ram plate. The entire machine is mounted on load cells which input total weight of the container/ram assembly to a controller which provides remote operation of the machine. This operates somewhat in reverse of traditional gravimetric systems which monitor the weight of the container being filled, here, the amount dispensed is measured and determined using the decrease in weight of the entire machine and container assembly.

The container is located on the base of the machine by spring loaded side guide rails which provide side-to-side positioning. The front-to-back position is determined by a mark on each guide rail. The position of the container need not be precise because the ram plate and pump unit is mounted on a ball and thrust bearing system which allows the plate to float freely above the container. The plate moves with 3 degrees of freedom (front-to-back, side-to-side, and rotationally) about the vertical axis of the container and ram cylinder.

The plate is lowered into the container and is located at the center of the container by an inflatable seal mounted around the plate. As the ram cylinder applies downward force to the ram plate, the final plate position is established.

The corners of the square container are sealed by inserts which are mounted to each corner of the ram plate. The inflatable seal is mounted in a channel having radius corners. The rubber corner seals are retained by the top and bottom plates that make up the channel. The rubber corner seals square off the radius inflatable seal and are forced into the inside corners of the container when the seal is inflated.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
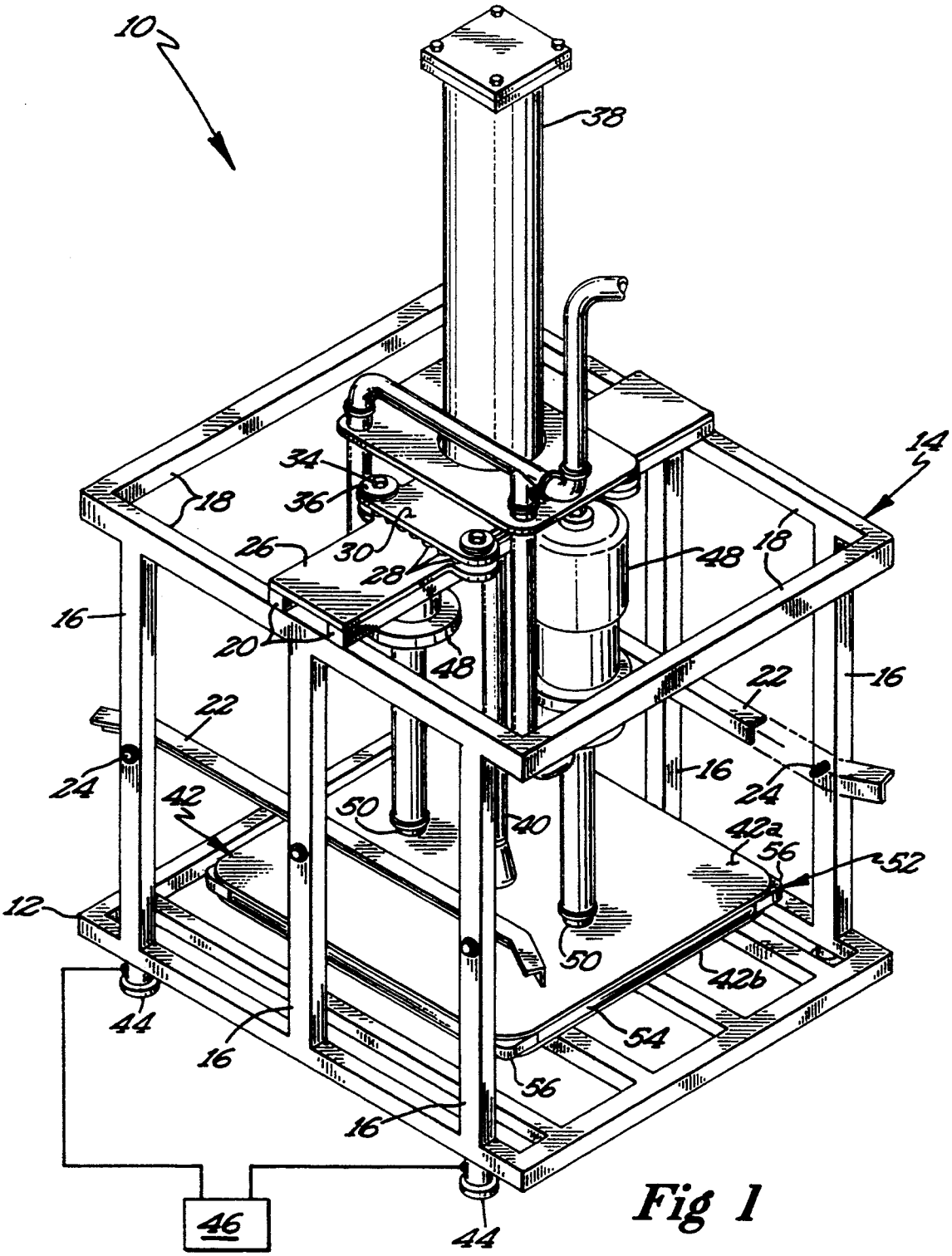
FIG. 1 is a perspective view of the instant invention.
Figure 2:
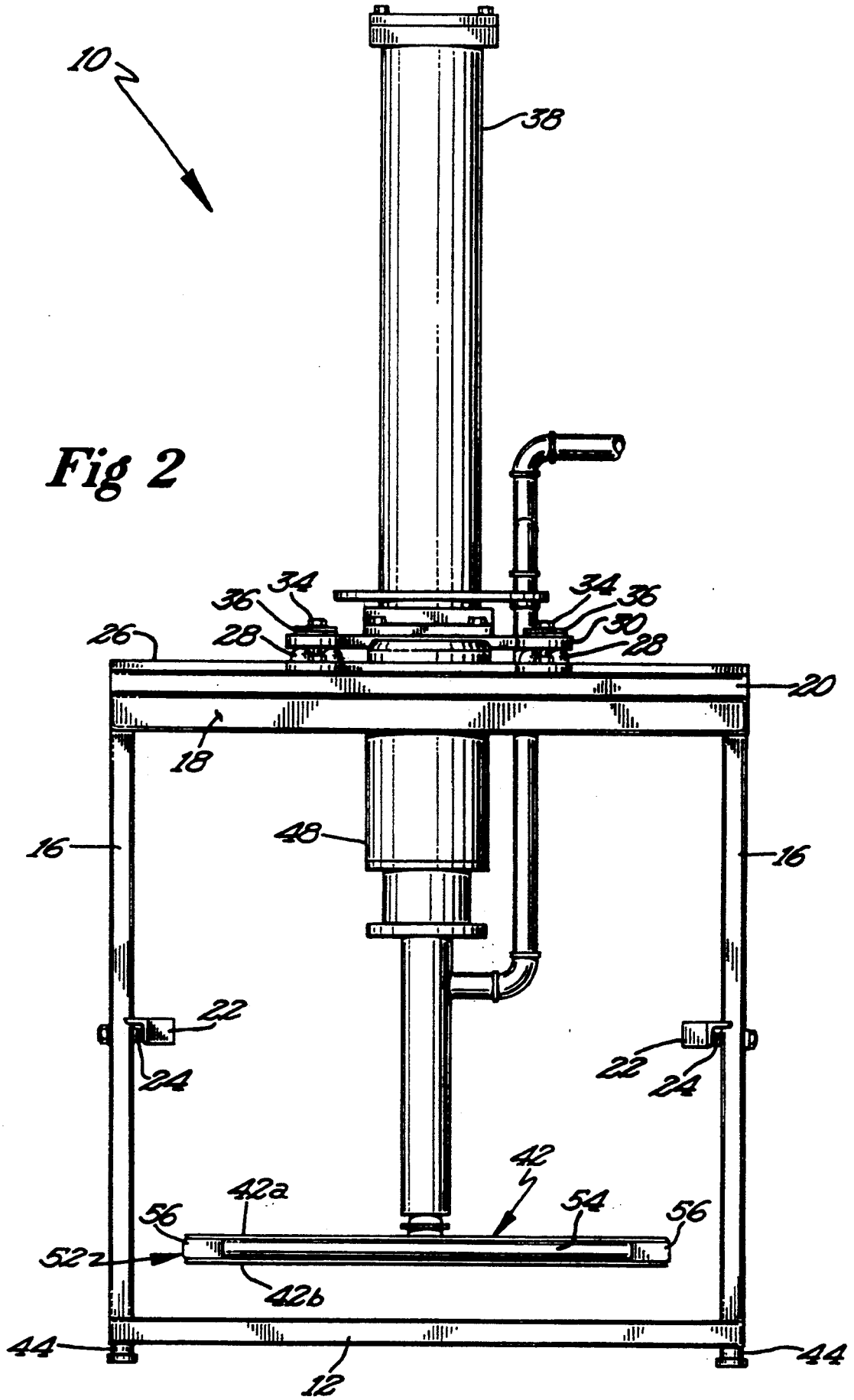
FIG. 2 is a front plan view of the instant invention.
Figure 3:
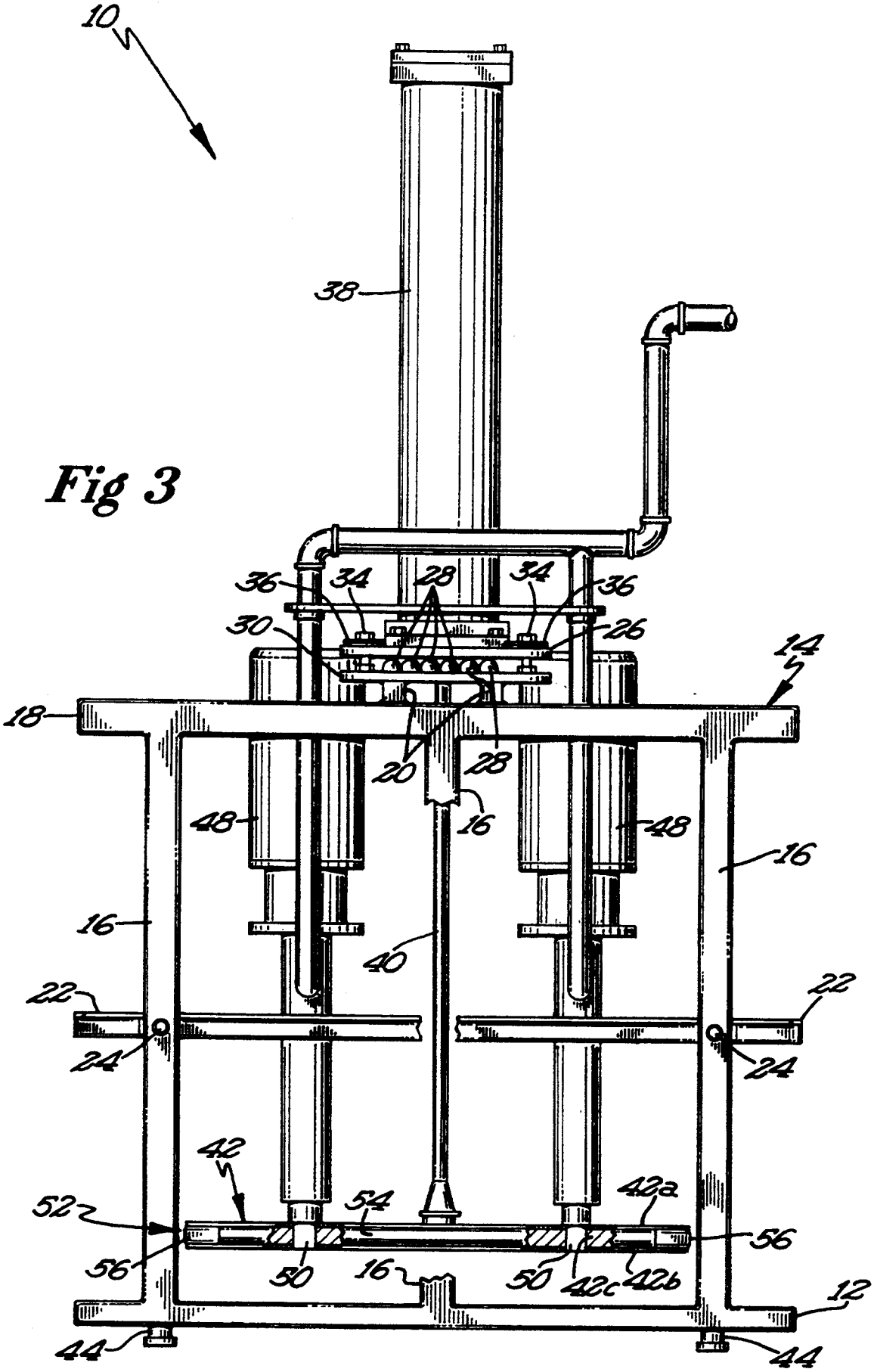
FIG. 3 is a side plan view of the instant invention.
Figure 4:
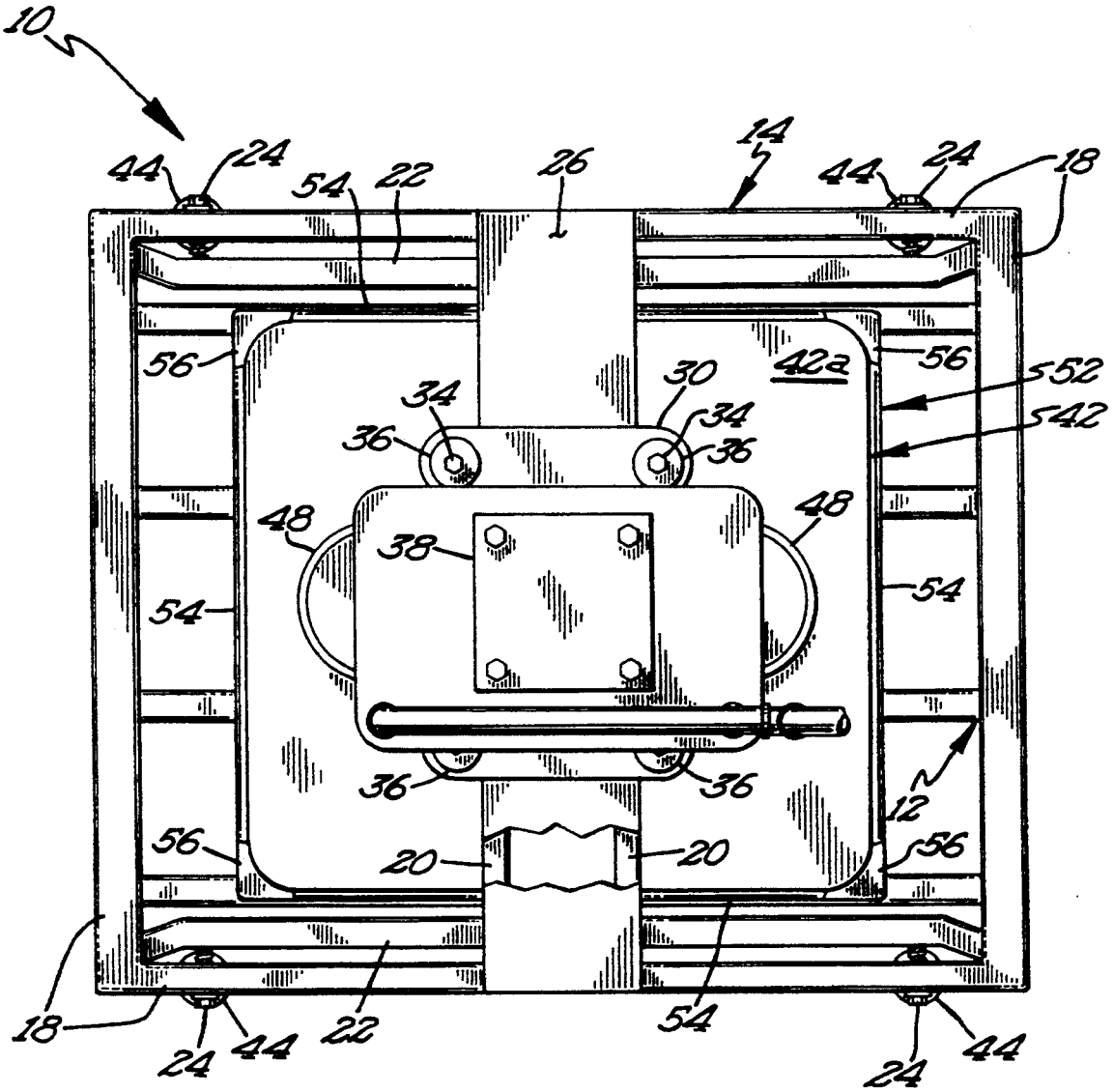
FIG. 4 is a top plan view of the instant invention.

The pump evacuation system of the instant invention, generally designated (10) is shown in perspective in FIG. 1. The mechanism is generally comprised of a rectangular base (12) which may be formed of square tubing and an upright frame (14) having vertical members (16) and upper members (18). A pair of upper cross members (20) connect the two upper frame members (18) on each side. A pair of side guide rails (22) serve to locate a bulk container (60) as will be more fully described hereinafter. Side rails (22) utilize a spring mounting mechanism (24) to allow some give in centering action.

Figure 5:
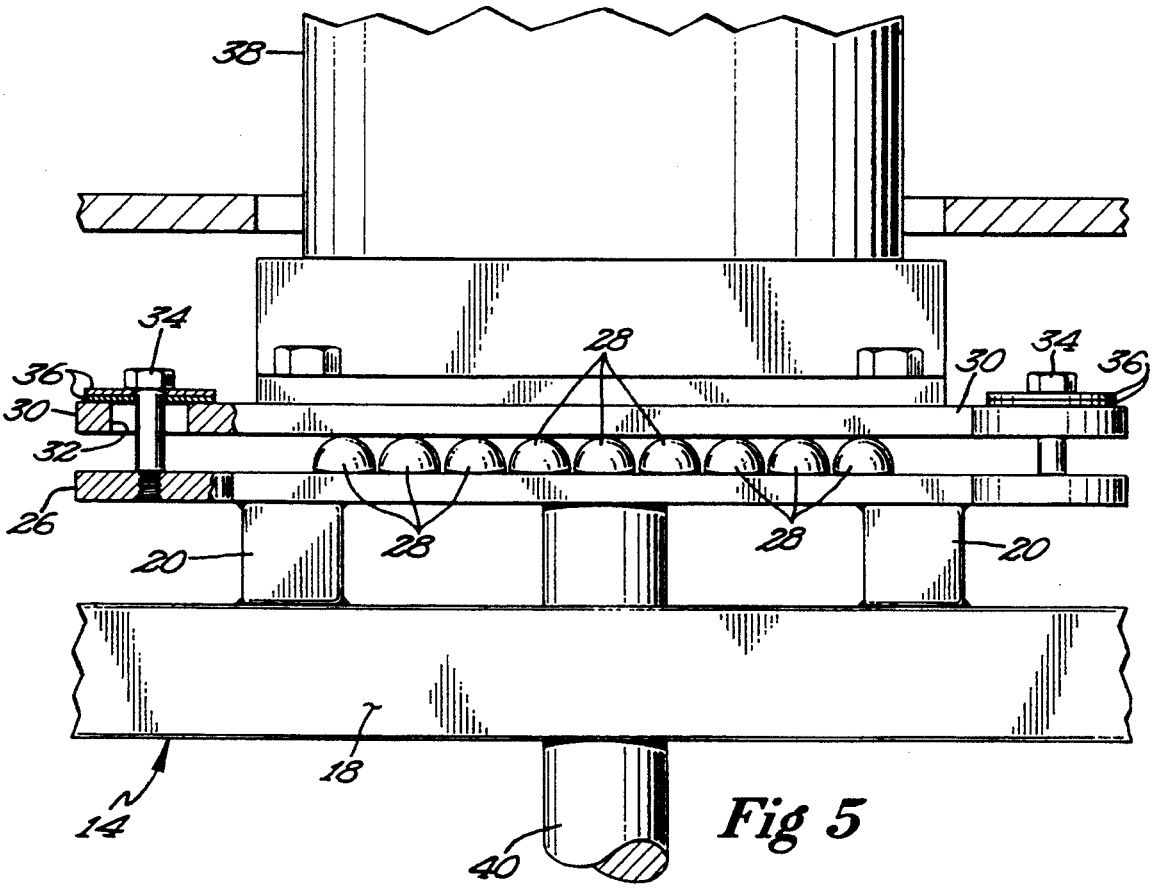
FIG. 5 is a detail view showing the roller thrust bearing system.

Turning to FIG. 5, frame cross members (20) have attached at the top thereof a lower bearing plate (26) and located in lower bearing plate (26) are a plurality of ball bearings (28) which can roll back and forth between lower plate (26) and upper plate (30). Upper plate (30) has holes (32) therein through which bolt (34) passes. It should be noted that hole (32) is substantially larger than bolt (34) in order to allow upper plate (30) to float relative to lower plate (26). A pair of thrust washers (36) are located under bolt (34) and allow sliding action. It should be noted that there is one bolt (34) located on each corner about cylinder (38).

Attached to upper plate (30) is air cylinder (38) which has extending downwardly therefrom a piston rod (40). Piston rod (40) is in turn attached to ram plate (42). Ram plate (42) has a channel around the edge thereof and is comprised of upper flange (42*a*), lower flange (42*b*) and channel base (42*c*). As can be particularly seen in FIG. 1, upper and lower flanges (42*a* and *b*) are generally square (or rectangular, or whatever shape is necessary to suit the container being evacuated). Channel base (42*c*) has rounded corners, and this serves to accommodate the sealing mechanism which will be more fully described hereinafter.

A plurality of load cells (44) are located beneath each corner of base (12) and can be attached to a controller (46) for controlling the operation of the device.

In the preferred embodiment, a pair of pumps (48) are mounted to the top of ram plate (42) which has corresponding apertures (50) therein to allow fluid to be forced into pumps (48) and thence to wherever it is desired to pump the fluid in the container.

Figure 6:
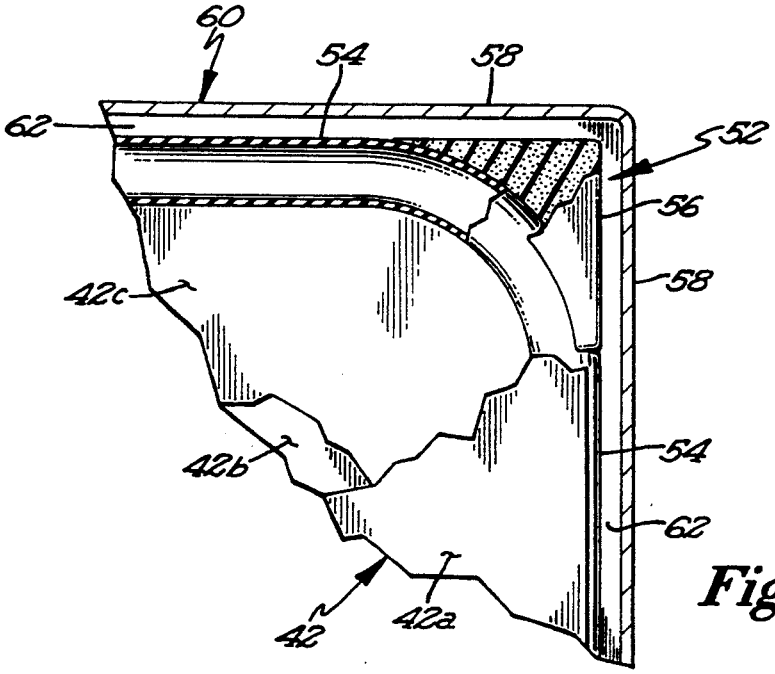
FIG. 6 is a detail view showing the corner seal of the instant invention.

The sealing assembly (52) is shown in general in FIG. 6 and is comprised of an inflatable seal (54) which is generally toroidal in cross section and fits in the channel (defined by 42*a*, 42*b* and base 42*c*) and is bounded at its other side by container wall (58) of bulk container (60). As shown in FIG. 6, seal (54) is deflated thereby providing a clearance (62) between wall (58) and seal (54) as well elastomeric corner seal (56). When it is desired to evacuate the container, ram plate (42) is lowered into the top of container (60) and seal (54) inflated which pushes corner seal (56) outwardly into the corner of container (60) providing a complete sealing mechanism.

Plate (42) is continued to be pushed downwardly by ram cylinder (34) until it reaches the bottom of the container. During this downward travel, pumps (48) pump material out of container (60) to be used.

It is contemplated that various changes and modifications may be made to the system without departing from the spirit and scope of the invention as defined by the following claims.

What is claimed is:

1. A pump evacuation system for a bulk container of high viscosity fluids, said system comprising:

a base;

a frame mounted on said base, said frame having a top and being sized to surround and receive said bulk container;

a ram cylinder having an axis of motion mounted to said frame top, said frame top having a center to which said ram cylinder is mounted, said ram cylinder being attached to said frame with means for allowing at least one degree of freedom relative to said axis;

a ram plate sized to fit into and force evacuation of said bulk container, said ram plate being attached to said ram cylinder so that said ram cylinder can press downwardly into said bulk container causing fluid to be evacuated therefrom, said means for allowing freedom allows said ram plate to rotate about said axis.

2. The pump evacuation system of claim 1 wherein said means for allowing freedom allows said ram plate to move normal to said axis.

3. The pump evacuation system of claim 1 further comprising at least one load cell associated with said base to sense the amount of material dispensed from said bulk container.

4. A pump evacuation system for use with bulk containers have a rectangular cross-section with a plurality of corners, said system having a ram plate assembly for forcible evacuating said bulk containers, said ram plate assembly comprising:

a ram plate generally conforming in size and shape to said container cross-section and further comprising a channel edge and rounded corners;

an inflatable wiper seal located in said channel; and a plurality of elastomeric corner seals located between said wiper seal and said container corners, each said corner seal having an inner surface generally conforming to said ram plate corners and an outer surface conforming to said container corners.

* * * * *